United States Patent [19]

Beaman

[11] 3,932,082

[45] Jan. 13, 1976

[54] MEANS FOR FORMING A REINFORCED CONCRETE MODULE

[76] Inventor: Samuel W. Beaman, 4780 Branch, Houston, Tex. 77021

[22] Filed: Jan. 21, 1974

[21] Appl. No.: 434,788

[52] U.S. Cl. ..... 425/125; 249/18; 249/93; 269/71

[51] Int. Cl.[2] ..... E04G 11/02

[58] Field of Search ..... 249/13, 18, 20–22, 249/27, 83, 91, 93, 137–138; 425/117, 112, 270 D, 272; 259/81 R, 88–89; 99/421 HV; 248/354 H; 269/71

[56] References Cited

UNITED STATES PATENTS

| | | | |
|---|---|---|---|
| 1,887,368 | 11/1932 | Zech | 249/93 |
| 2,042,443 | 5/1936 | Buckstone | 248/354 H |
| 2,198,134 | 4/1940 | Spiegl | 99/421 HV |
| 2,819,873 | 1/1958 | Pearne | 248/354 H |
| 2,845,856 | 8/1958 | Sack | 99/421 HV |
| 2,958,508 | 11/1960 | Martinez | 248/354 H |
| 3,359,888 | 12/1967 | Deege et al. | 99/421 HV |
| 3,371,901 | 3/1968 | Groetschel | 248/354 H |
| 3,387,555 | 6/1968 | Moran | 99/421 HV |

*Primary Examiner*—Robert D. Baldwin
*Assistant Examiner*—John McQuade
*Attorney, Agent, or Firm*—Pravel & Wilson

[57] ABSTRACT

Apparatus for constructing reinforced concrete modular construction units comprising longitudinally extending multi-sided construction units. Reinforcing bars and mesh are formed into a cage of the desired size and shape for the particular unit. Such cage is mounted on a rotatable shaft which may also be raised and lowered relative to a horizontal bed. Each side of the modular construction unit is in turn positioned in a perimeter form on the bed in which the concrete is poured and finished flat to form each side of the modular unit. After each side has cured a sufficient time to insure its structural integrity the cage is raised and rotated to align another side of the cage with the horizontal bed. The cage is lowered into position adjacent the bed in a suitable form and concrete is poured around the reinforcing structure on that side of the cage to form that side of the wall of the building. Successive sides are similarly formed until the longitudinally extending hollow construction unit has been completed. Thereafter, end walls are formed in the tubular member to enclose the modular building unit.

6 Claims, 4 Drawing Figures

MEANS FOR FORMING A REINFORCED CONCRETE MODULE

BACKGROUND OF THE INVENTION

1. Field of the Invention

The present invention relates to an apparatus for forming reinforced concrete modular construction units.

2. Description of the Prior Art

Although there are numerous prior art concrete building methods and apparatus for forming concrete structures, each of these normally requires the use of a multitude of forms, generally requiring forms for each wall and thereby require the expenditure of substantial amounts of time in setting up and removing the forms for each structure which is made with the forms.

SUMMARY OF THE INVENTION

The present invention provides a new and improved apparatus for constructing reinforced concrete modular buildings. The typical reinforced concrete building structures heretofore have required an elaborate forming system for shaping the building to the desired contour. This normally requires building or assembling of interior and exterior forms to create a mold for receiving the liquid concrete to thereby form a wall when the concrete cures. One of the obvious disadvantages of this arrangement is that inherently it requires a duplication of efforts to first form the walls of form material and then form the walls of the reinforced concrete a second time. One of the advantages of Applicant's invention is that it provides an apparatus whereby a slab is first poured on the ground and finished smooth and thereafter is used for receiving the concrete which forms each wall as well as the floor and roof. The slab in effect becomes a part of the form although it remains permanently in place on the ground. A perimeter form is placed on the slab for receiving the steel rod and wire reinforcing material and with such wire properly spaced from the slab, the liquid concrete is poured into place and finished in a horizontal position which is the most efficient way of finishing concrete.

DESCRIPTION OF THE PREFERRED EMBODIMENT

Figure 1:
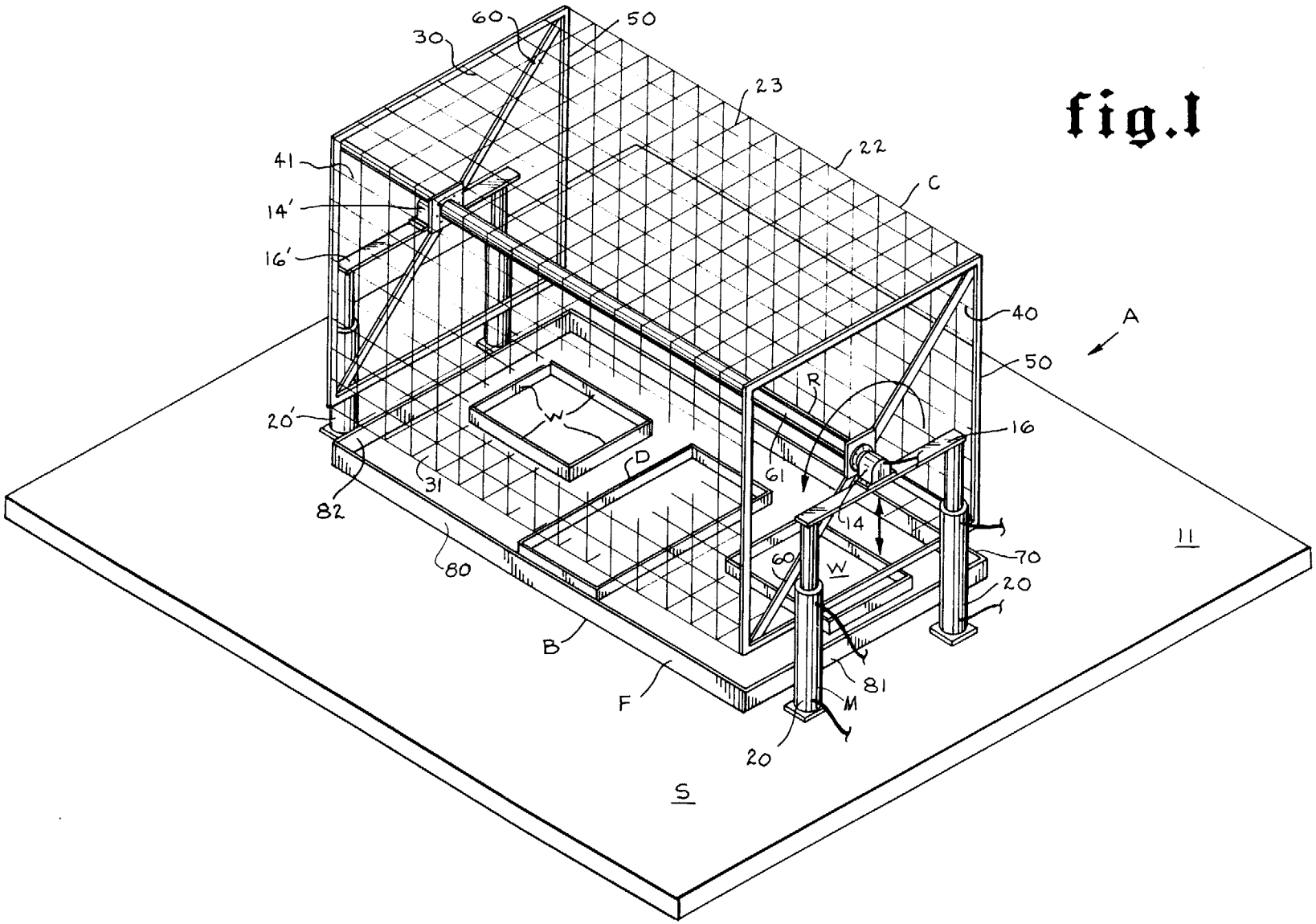
FIG. 1 is an isometric view showing the cage of reinforcing wire and rods mounted on a rotatable support.

The apparatus of the present invention is designated generally A in FIG. 1 of the drawings. Such apparatus includes a rotatable shaft R which is rotatably mounted at each end on vertical supports M by which the shaft R may be raised and lowered, as desired. Such shaft R carries a rotatable cage or framework C formed of reinforcing bars and/or reinforcing mesh or other suitable concrete reinforcing material which is used in forming the walls as well as the top and bottom of the modular structures. As shown, a slab or forming surface S is first formed on the ground and finished with the smooth upper surface so as to provide a smooth finish in the exterior side of the construction unit. A suitable perimeter form F is set on the slab for forming the sides of the construction unit.

Considering now the apparatus of the present invention in more detail, the slab S is normally formed at the building site on the ground with a smooth upper surface 11 which can be smoothed to the same finish that one desires on the exterior walls of the building. It will be appreciated that the slab S forms the bottom of the mold or form in which the concrete is poured and thus becomes an integral form portion in the apparatus and method of the present invention. Also, a steel plate or other suitable surface can be used as the bottom of the form, if desired. The upper surface 11 is either treated with an oil or other suitable material to prevent sticking between the concrete poured on the slab and the slab itself or if desired, other steps well known in the art may be taken to prevent the side walls of the building from adhering to the upper surface of the slab S.

As shown in FIG. 1 of the drawings the rotatable shaft R is positioned at the center of the cage C. Such shaft is rotatably mounted in suitable bearing supports 14 which are positioned on a transversely extending beam or plate 16 which is supported at its opposite ends by hydraulic cylinders or other suitable raising and lowering devices 20. It will be appreciated that the beam 16 may be raised and lowered either mechanically such as with wenches and lines or hydraulically; however, in the preferred form of this invention, the shaft R is shown raised and lowered by the hydraulic devices. Further, it will be appreciated that a similar transverse beam 16' is provided at the opposite end of the rotatable shaft R from the beam 16 and that such shaft is rotatably mounted in a suitable bearing 14' carried on the beam 16'. Such beam 16' is raised and lowered by suitable hydraulic piston 20'.

The cage C is formed of reinforcing bars 22 which run longitudinally of such cage as well as bars 23 which run laterally of cage C in the sides 30 and 31 and also in the top 40 and the bottom 41 of the cage. Further, it will be appreciated that wire mesh or other suitable concrete reinforcing material may be used to reinforce the concrete forming the sides as well as the top and the bottom of each of the construction units. The cage C is formed on suitable end members 50 which have substantially the same configuration as a cross-section of the housing and such end support members have cross beams 60 and 61 extending diagonally from corner to corner of the construction unit. Such end 50 is positioned at either end of the cage C as are the diagonal cross support members 60 and 61. Further, it will be appreciated that intermediate support frames may be provided between the opposite ends of the cage C, as desired.

The form F comprises a perimeter form which includes a top 70, bottom 80 and ends 81 and 82. During the forming process, the form F extends around the walls formed with apparatus A.

As shown in FIG. 1 of the drawings, the side of the cage C which is adjacent of the upper surface of the slab S is provided with additional forms such as the window forms W and the door form D. Of course, the reinforcing wire mesh is removed from those areas which are encompassed by doors, windows or other openings so as to be formed at the same time that the wall is formed.

With the cage C oriented relative to the form F in a position shown in FIG. 1 of the drawings such cage is lowered so as to space the reinforcing rods or wires in the side 31 a suitable distance from the slab S. Thereafter, concrete is poured into the form F and then finished smooth inside of the cage in a substantially horizontal position.

Figure 3:
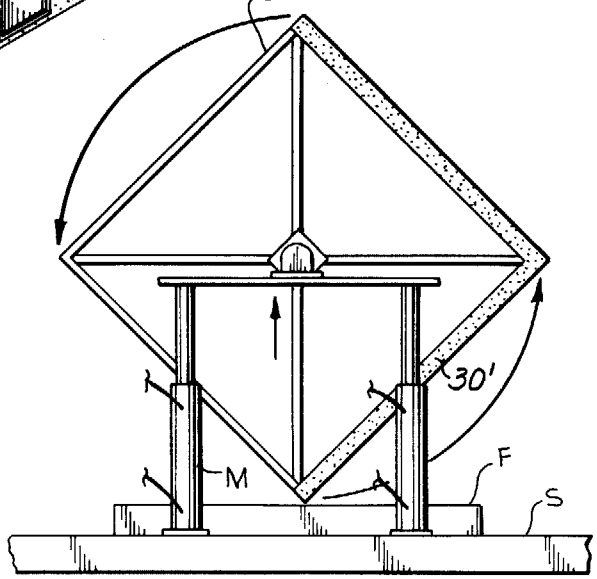
FIG. 3 is an end view showing the cage reinforcing wire cage partially rotated.
Figure 4:
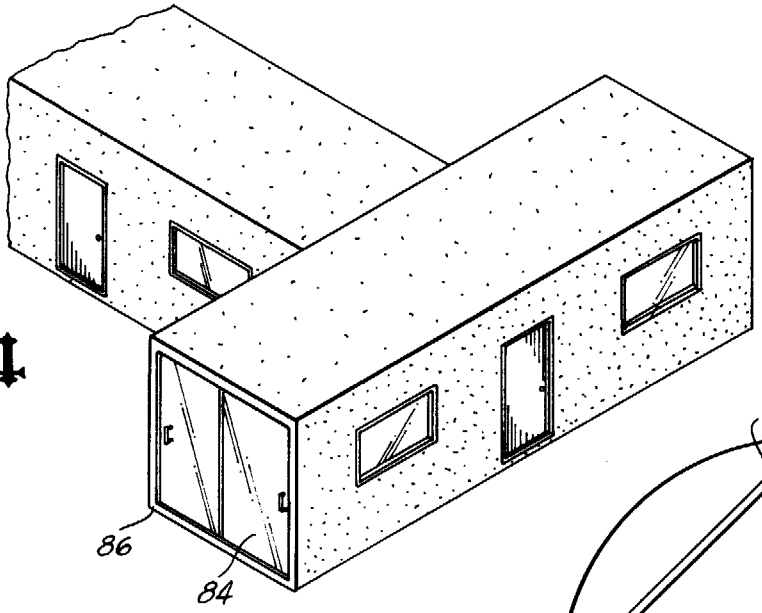
FIG. 4 is an isometric view of two construction units joined together to form a single building.
Figure 2:
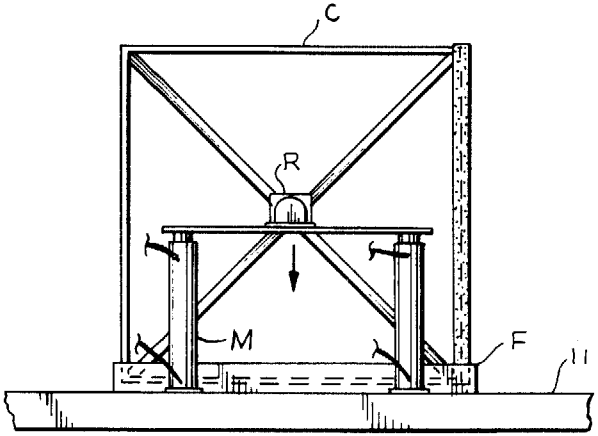
FIG. 2 is an end view showing the apparatus for raising and lowering the reinforcing cage relative to the slab.

After the concrete forming the wall 30' has cured sufficiently to insure its structural integrity, the rotatable shaft R on which the cage C is mounted is lifted by the hydraulic lifting pistons 20 and 20' into the position shown in FIG. 3 of the drawings and the cage C rotated so as to position another side of the cage C substantially parallel to the slab S. Thereafter, the rotatable shaft R carrying the cage C is lowered by the hydraulic lifting devices 20 and 20' to position the lower adjacent side of such cage in the form F but to support it a suitable distance from the upper surface 11 of the slab for receiving concrete. Thereafter, the concrete is poured into the form F so as to cover the wire mesh side of the cage C, and thereafter, the upper surface of such concrete is flat finished in the perimeter form F. When that side has cured sufficiently to insure its structural integrity, the rotatable shaft R is again raised and the cage C rotated so as to present a third side to the slab S for forming the form F and, after the third side has been formed, a fourth side is then formed so as to construct a four-sided unitary concrete modular structure. Thereafter, sliding glass doors 84 or other suitable closure means are installed in the opposite open ends such as open end 86 of the concrete structure so as to provide a closed-in structure. Also, as illustrated in FIG. 4 of the drawings, it will be appreciated that two or more of such structures may be joined together to provide a structure of some desired configuration.

After the four sides which include the top and bottom of the structure have been formed and have cured sufficiently to permit the structure to be moved, the concrete structure may be lifted by the hydraulic pistons and set on a trailer or other suitable moving carriage and thereafter, the rotatable shaft R and its end support members are withdrawn from the structure and it may then be moved to another location. Also, the rotatable shaft and the associated internal bracing may be left in the tubular structure during moving, if desired. Internal X bracing will be used at suitable intervals intermediate the ends of the tubular member, as shown in FIG. 1.

The foregoing disclosure and description of the invention are illustrative and explanatory thereof, and various changes in the size, shape and materials as well as in the details of the illustrated construction may be made without departing from the spirit of the invention.

I claim:

1. An apparatus for use in forming reinforced concrete modular construction units, comprising:

a. support means;

b. a shaft mounted with said support means for rotational movement with respect thereto;

c. cage means mounted on said shaft for movement therewith for forming a plurality of concrete receiving surfaces of concrete reinforcing material about which concrete is cast, each of said surfaces with concrete cast thereon forming an integral part of a modular construction unit; and d. a vertical positioning means mounted with said support means for moving said support means and shaft vertically to adjust the vertical position of said cage means surfaces between lower position in which concrete is cast about said surfaces and an upper position in which said shaft is rotated, so that by selective rotation and vertical positioning, said cage means surfaces are positioned for casting concrete on each of said surfaces to form a reinforced concrete modular construction unit.

2. The invention of claim 1, further including:

a substantially horizontal base mounted beneath said cage means adjacent which said cage means surfaces are placed for receiving concretes.

3. The invention of claim 1, further including:

a perimeter form mounted beneath said cage means for forming a confined area in which concrete is cast on said cage means surfaces.

4. The invention of claim 1, wherein:

said cage means surfaces are formed into a multisided enclosure surrounding said rotatable shaft.

5. The invention of claim 1, wherein:

said vertical positioning means includes hydraulic cylinders at each end of said shaft.

6. The invention of claim 1, further including:

end members mounted at opposing ends of said shaft for supporting the concrete reinforcing material intermediate opposite ends of said shaft.

* * * * *